US005909840A

United States Patent [19]

Schultheiss

[11] Patent Number: 5,909,840

[45] Date of Patent: Jun. 8, 1999

[54] CLAMSHELL CARTON WITH PARTITIONS

[75] Inventor: Karl F. Schultheiss, Middletown, Ohio

[73] Assignee: Dopaco, Inc., Exton, Pa.

[21] Appl. No.: 09/122,662

[22] Filed: Jul. 27, 1998

[51] Int. Cl.[6] ..... B65D 5/488

[52] U.S. Cl. ..... 229/120.17; 229/114; 229/120.13; 229/172

[58] Field of Search ..... 229/114, 120.13, 229/120.17, 172, 173

[56] References Cited

U.S. PATENT DOCUMENTS

| | | | |
|---|---|---|---|
| 713,216 | 11/1902 | Henning | 229/120.13 |
| 1,466,344 | 8/1923 | Sardou | 229/120.13 |
| 2,465,169 | 3/1949 | O'Connor | 229/173 |
| 3,032,250 | 5/1962 | Noller et al. . | |
| 4,081,125 | 3/1978 | Meyers . | |
| 4,089,458 | 5/1978 | Meyers et al. | 229/120.17 |
| 4,431,128 | 2/1984 | Dirico . | |
| 4,905,889 | 3/1990 | Schuster . | |
| 5,049,710 | 9/1991 | Prosise et al. . | |
| 5,167,325 | 12/1992 | Sykora . | |
| 5,205,475 | 4/1993 | Sorenson . | |
| 5,249,736 | 10/1993 | Eisman . | |
| 5,335,845 | 8/1994 | Liu | 229/120.17 |
| 5,718,370 | 2/1998 | Lafferty et al. . | |

FOREIGN PATENT DOCUMENTS

| | | | |
|---|---|---|---|
| 319418 | 1/1970 | Switzerland | 229/120.17 |
| 578758 | 7/1946 | United Kingdom | 229/173 |

*Primary Examiner*—Gary E. Elkins
*Attorney, Agent, or Firm*—Dennison, Meserole, Scheiner & Schultz

[57] ABSTRACT

A clamshell carton wherein the tray includes a partition panel integral with the upper edge of the front wall and folded to overlie the interior of the front wall and a major portion of the bottom panel. The partition panel including a partition section selectively upwardly foldable at an intermediate and preferably central portion of the tray to define two food-receiving compartments therein.

18 Claims, 4 Drawing Sheets

CLAMSHELL CARTON WITH PARTITIONS

BACKGROUND OF THE INVENTION

The present invention broadly relates to containers for use in the fast food industry. Such containers, preferably formed of folded paperboard, cardboard and the like, come in a variety of shapes and sizes. Many factors go into the design of such containers including the nature of the food product or products to be received therein, the cost of the material involved, the ease of manufacture and use thereof, the adaptability of the formed container to convenient shipping and storage, and like factors which ultimately result in an economically feasible and practical food container.

One basic form of container is what is commonly referred to as a clamshell or clamshell carton which includes a tray with upwardly and slightly outwardly flaring peripheral walls, and a similarly configured inverted cover, integrally with one of the tray walls and overlying the tray, with appropriate latch means releasably joining the cover to the tray. Such cartons come in many sizes and shapes to accommodate particular foodstuffs.

Other known cartons are provided with internal partitions, dividing the interior thereof into plural compartments, normally to accommodate different foodstuffs in a single carton.

SUMMARY OF THE INVENTION

It is a significant object of the present invention to provide a clamshell carton with an internal partition, and doing so in a manner which allows for the use of a single blank, retains the highly desirable stackable nature of conventional clamshell cartons, allows for optional use of the partition at the actual point of sale of the product to be placed therein, and otherwise provides for practical and economically desirable improvements in carton construction.

More specifically, the carton of the invention comprises a tray with peripheral upward and outwardly angled peripheral walls, including opposed side walls and a rear wall of generally equal height and a relatively higher front wall. The front wall includes integral keeper lugs extending from the opposed ends thereof, adjacent the top edge of the front wall, to project beyond the opposed side walls. A partition panel is integral with the upper edge of the front wall along the full length thereof and folds inwardly therefrom to conform to and overlie the inner face of the front wall and extend rearward therefrom, conforming to and overlying the base panel of the tray for slightly less than the full extent thereof toward the rear wall. The rear portion of the partition panel is selectively upwardly folded to define a partition intermediate the front and rear tray walls and extending generally parallel thereto with the height of the partition being slightly greater than that of the tray side walls for easy access thereto.

The cover of the carton includes a rear wall of substantially equal height with the rear wall of the tray and integrally formed therewith along the full length of the upper edges of the rear wall. The lid also includes opposed side walls of a greater height which, in the closed carton, outwardly overlie the side walls of the tray. The forward wall of the cover is of substantially equal height with the rear wall thereof and, in the closed carton, is received immediately inward of the tray front wall and the first portion of the partition panel. The side walls of the cover include, along the outer edges thereof, forwardly projecting cover locking lugs which, in the closed carton, engage beneath the tray keeper lugs for a releasable fixing of the cover in a closed position over the tray.

The carton, thus formed, and prior to an upward folding of the partition, can be stacked in the manner of a conventional formed clamshell carton. In use, and as desired, the carton can be used for a single food product by merely not upwardly folding the partition. However, should one wish to accommodate two food products, as for example two hot dogs, separately and individually within the carton, the server of the food products need merely quickly upwardly fold the easily accessed partition to provide two segregated compartments.

Other features of the invention, and advantages derived therefrom, will become apparent from the following more detailed description of the carton.

DESCRIPTION OF PREFERRED EMBODIMENTS

Figure 1:
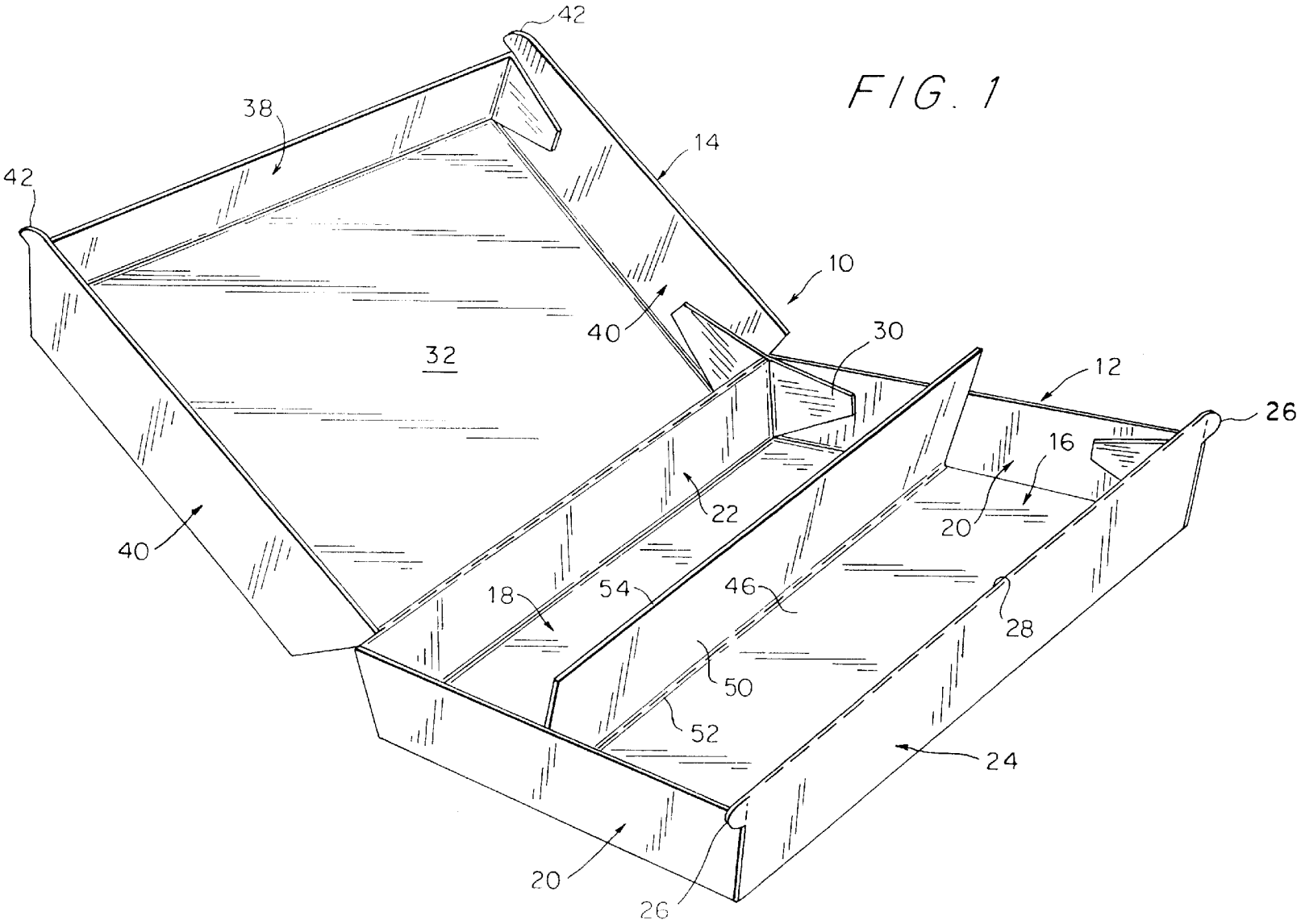
FIG. 1 is a perspective view of the carton of the invention with the cover open and the partition erected.
Figure 2:
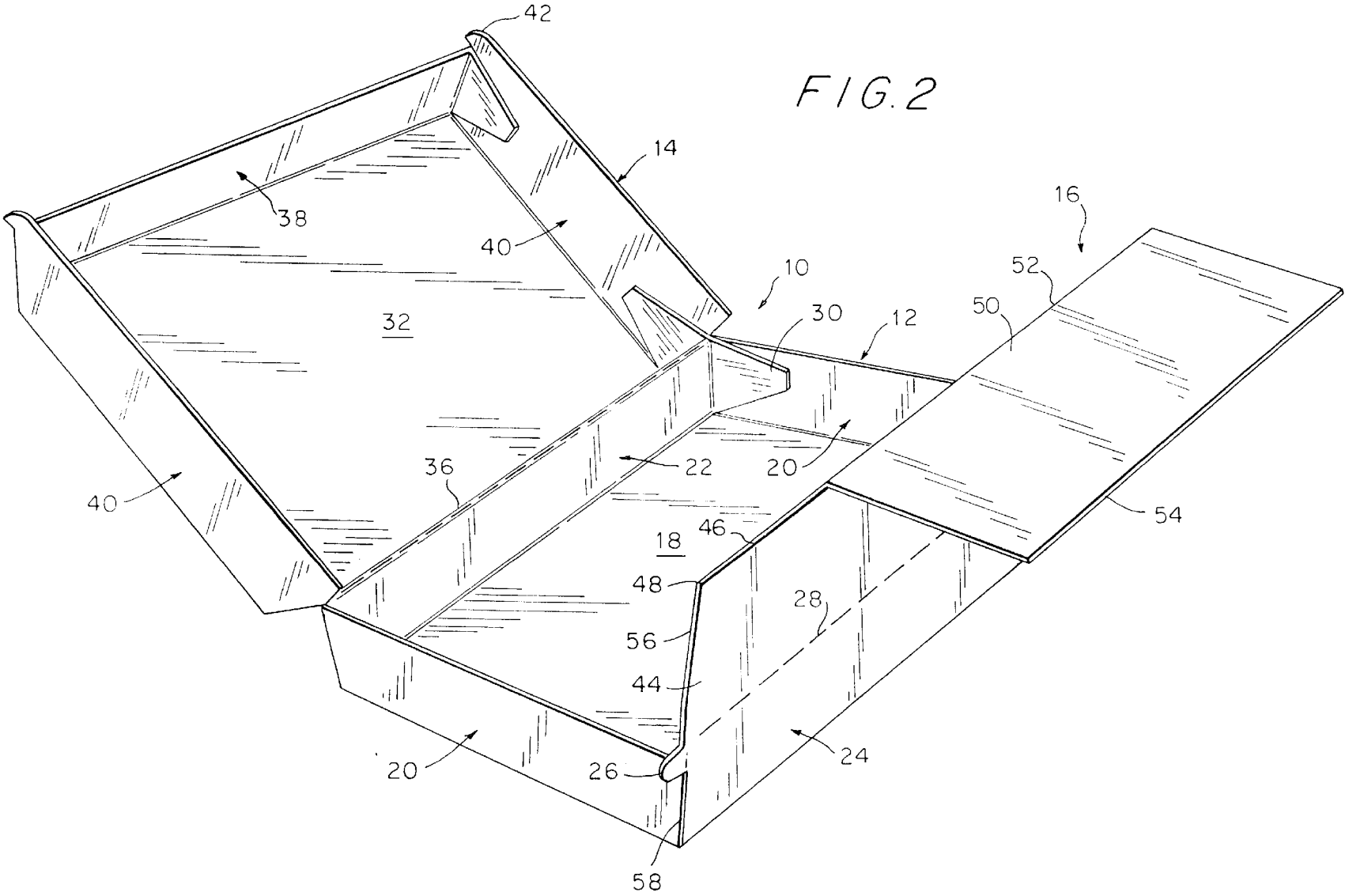
FIG. 2 is a front perspective view with the partition panel partially removed from the carton tray for purposes of illustration.

Referring now more specifically to the drawings, the carton 10 is basically of a clamshell construction including a tray 12 and a cover 14 with an integral partition panel 16 for selective modification of the interior of the tray 12 in accord with the foodstuff or food products to be packaged therein. The tray and cover are of complementary configurations, preferably rectangular.

The tray 12 includes a bottom or bottom panel 18 with integral walls, including opposed side walls 20, a rear wall 22 and a front wall 24, about the periphery of the bottom 18 and extending upwardly therefrom at a slightly outwardly inclined angle from the vertical. The side walls 20 and rear wall 22 are of equal height, while the front wall 24 is of a greater height and includes longitudinally extending coplanar keeper lugs or tabs 26 immediately below the upper edge 28 of the front wall 24 and extending laterally beyond the opposed side walls 20. The walls 20, 22 and 24 are maintained in their upright tray-defining position by adhesive flaps 30 integral with the opposed ends of the tray rear and front walls 22 and 24, which flaps 30 overlap and are adhesively secured to the inner faces of the opposed side walls 20.

The cover 14 is similarly configured and includes a top or top panel 32 with integral peripheral walls which, assuming the closed position of the cover 14, extend downward and incline slightly outward from the vertical. Such walls include a rear wall 34 of substantially equal height with the rear wall 22 of the tray and integrally joined thereto along the coextensive upper edges thereof to define a hinge line 36 allowing for a selective folding of the cover over the tray. The front wall 38 of the cover 14 is of equal or substantially equal height with the rear wall 34 thereof and the opposed side walls 40 are of equal or substantially equal height with the tray front wall 24, and thus of greater height than the rear and front walls of the cover. Each of the side walls 40 includes a coplanar and integral projecting locking lug 42 adjacent the lower edge thereof and extending laterally beyond the cover front wall 38 immediately therebelow, again in the closed cover.

Upon a closing of the cover, the front wall 38 of the cover engages inward of the relatively taller front wall 24 of the tray, while the cover side walls 40 engage over and outward of the relatively shorter side walls 20 of the tray with the lock lugs 42 snap-engaging beneath the keeper lugs 26 due to the inherent flexible resiliency of the paperboard material of the carton. The opening of the cover is similarly easily effected.

Referring now more specifically to the partition panel 16, this panel has a forward edge integral and coextensive with the upper edge 28 of the tray front wall 24 with a fold line defined therealong to enable an inward folding of the partition panel 16 into the tray 12.

Figure 5:
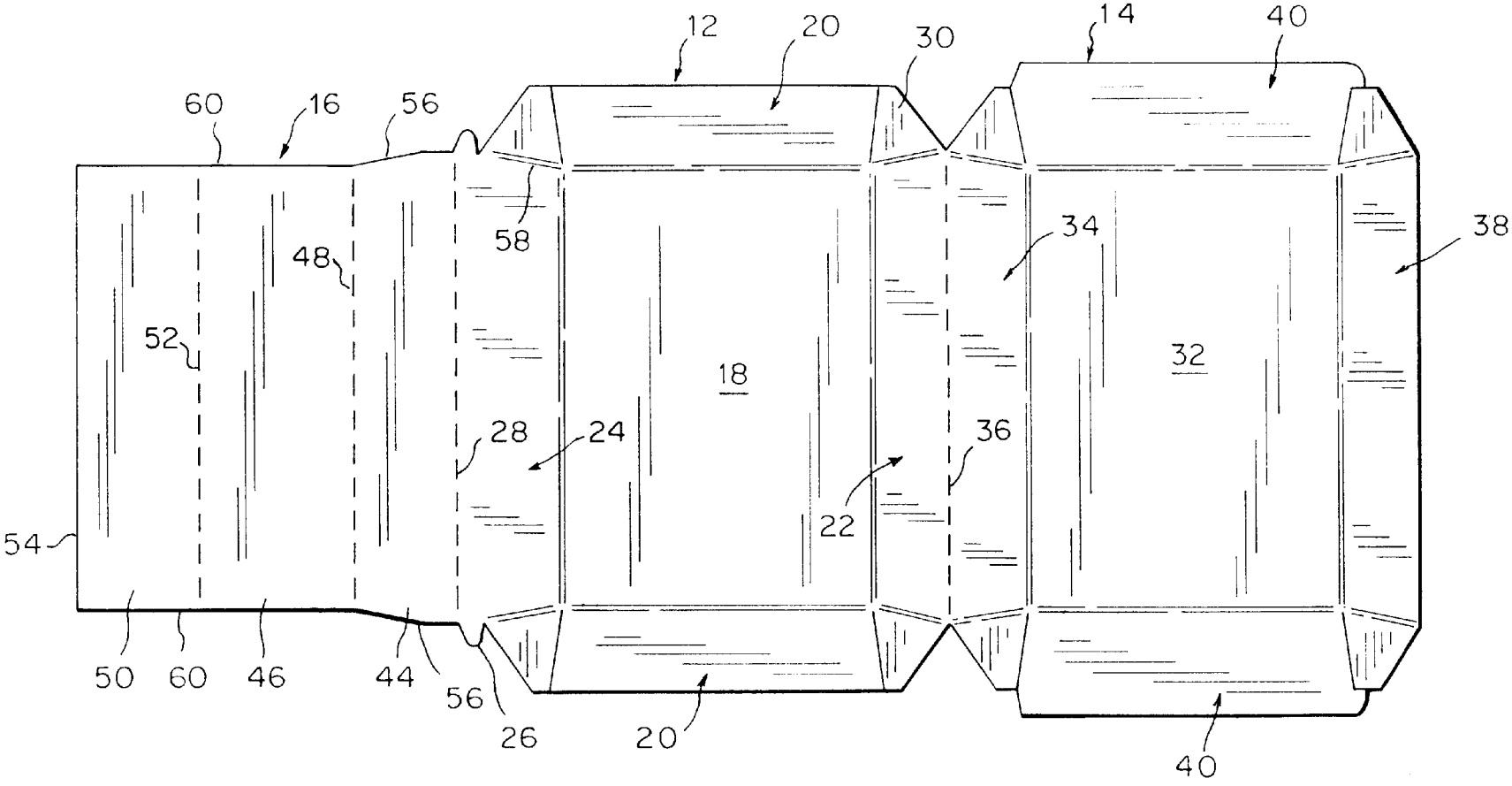
FIG. 5 is a plan view of the unitary blank from which the carton is formed.

The partition panel 16, noting the blank of FIG. 5 in particular, includes three parallel sections transversely thereacross, a front section 44 foldable at the upper edge 28 of the tray front wall 24, an intermediate section 46 integral with the front section 44 along fold line 48, and a partition or partition section 50 coextensive with and integral with the intermediate section 46 along fold line 52. The partition 50 has a free outer edge 54 paralleling the fold lines 48 and 52.

The partition panel sections 46 and 50 are of equal width between side edges 60, which width is substantially equal to the width of the tray bottom 18 between the opposed side walls 20. This width is such as to enable these sections 46 and 50 to be closely received in overlying relation to the tray bottom 18 between the side walls 20 thereof. The upwardly flaring nature of the side walls 20 facilitating an insertion of the partition panel into overlying position with the tray bottom.

The front section 44 of the partition panel 16 conforms to the tray front wall 24. As such, it will be noted that the opposed side edges 56 of the front section 44 adjacent edge 28, are initially parallel and then converge slightly toward the fold line 48, thus conforming to the slightly converging end edges 58 of the tray front wall 24 which contribute to the desired slight outward angling thereof in the erected carton. The parallel portions of the side edges 56 are coextensive with the upper portion of the tray front wall 24 from which the keeper lugs extend.

Figure 3:
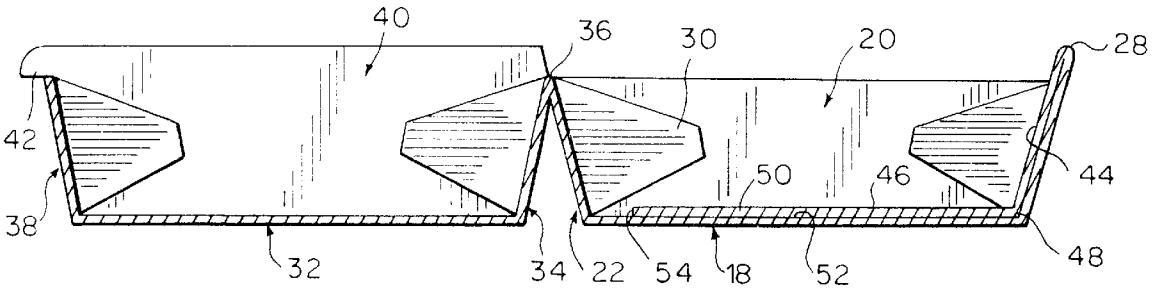
FIG. 3 is an enlarged cross sectional detail through the closed carton with the partition retained over the tray bottom panel in an unfolded position.
Figure 4:
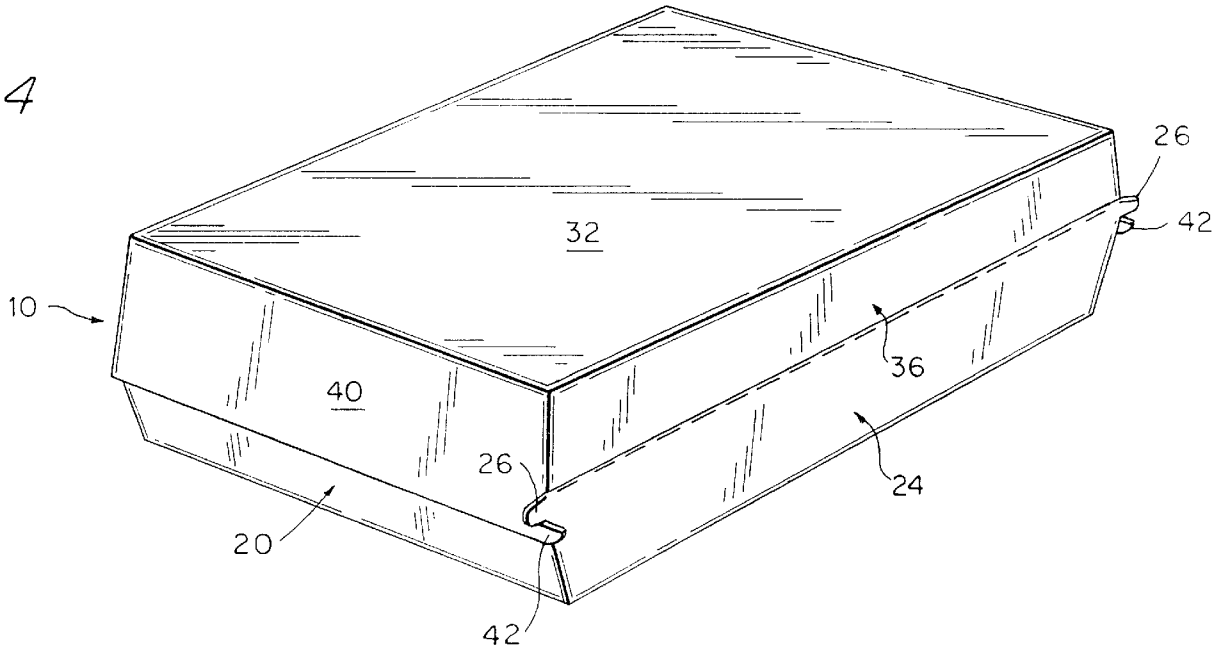
FIG. 4 is a front perspective view of the closed carton illustrating the interlocked lugs.

Turning now to the length of the partition panel from the upper edge 28 of the front wall to the outer edge 54 of the partition 50, and noting FIG. 3 in particular, it will be seen that the front section 44, between the edge 28 and the fold line 48, is coextensive with the height of the tray front wall 24. The intermediate section and partition 50, between fold line 48 and the free edge 54 is slightly less than the depth of the tray. Thus, with the intermediate and partition sections 46 and 50 overlying the bottom 18, as in FIG. 3, a space is provided between edge 54 and tray rear wall 22 whereby one can easily access the free edge 54 for an upward folding of the partition 50 to the partitioning position illustrated in FIG. 1. With continued reference to FIG. 1, it will also be noted that the partition 50, between the fold line 52 and edge 54, is slightly higher than the tray side walls 20 but less than the overall height of the closed carton, thus allowing for free access to the partition 50, as for example an aid in removing foodstuff from the formed forward compartment or chamber by physically upwardly pivoting the partition panel 16, while at the same time allowing for a full closing of the tray cover.

With continued reference to FIG. 3, it will be appreciated that with the partition 50 unfolded, that is directly overlying the bottom 18, a single food-receiving chamber or compartment is provided, possibly for a hamburger or the like. So arranged, it will also be appreciated that the cartons can be conveniently stacked for storage and shipment by merely internesting cartons into a compact and conveniently handled stack with no wasted space. When the partition 50 is to be used, the food dispenser need merely engage the free edge 54 and upwardly fold partition into the configuration of FIG. 1. In this configuration, two receiving compartments or chambers are formed, as for two hot dogs, a single hot dog and an appropriate side order of french fries, and similar such uses.

With reference to the blank of FIG. 5, it will be appreciated that the versatile partition panel 16 is provided for as an integral extension of the blank used in the formation of the tray and cover components of the clamshell carton. The partition panel, while extending the length of the blank, is of a lesser transverse width, thus minimizing the amount of material required in providing for a unique selectively partitioned food-receiving tray.

The foregoing is illustrative of a preferred embodiment of the invention. It is to be appreciated that other embodiments, incorporating the features of the invention as set forth in the claims, are also to be considered to be within the scope of protection afforded by the claims.

I claim:

1. A carton comprising a tray and a cover, said tray comprising a bottom panel with a periphery, front and rear walls integral with and extending upward from said periphery, side walls integral with and extending upward from said periphery between said front and rear walls, each of said walls having an upper edge, said cover being integral with and foldable relative to said tray along the upper edge of said rear wall between an open position with the cover remote from said tray and a closed position with the cover overlying said tray, and a unitary partition panel having a front edge integral with and foldable relative to said front wall along the upper edge thereof, said partition panel including a front section overlying said front wall, an intermediate section extending from said front section and engaged on and overlying said tray bottom panel, and a partition extending from said intermediate section and selectively foldable between a first position engaged on and overlying said tray bottom panel, and a second position extending upward from said intermediate section between said front and rear walls of said tray.

2. The carton of claim 1 wherein said partition, in said second position thereof, extends above said upper edges of said side walls.

3. The carton of claim 2 wherein said front edge of said partition panel is substantially coextensive with said upper edge of said front wall.

4. The carton of claim 3 wherein said bottom panel is of a predetermined width between said side walls, said intermediate section and said partition being of substantially equal width which is substantially equal to said predetermined width.

5. The carton of claim 4 wherein said partition has a free outer edge remote from said intermediate section, said free outer edge, in said first position of said partition, being forwardly spaced from said tray rear wall for facilitating access thereto.

6. The carton of claim 1 wherein said front edge of said partition panel is substantially coextensive with said upper edge of said front wall.

7. The carton of claim 6 wherein said bottom panel is of a predetermined width between said side walls, said intermediate section and said partition being of substantially equal width which is substantially equal to said predetermined width.

8. The carton of claim 6 wherein said partition has a free outer edge remote from said intermediate section, said free outer edge, in said first position of said partition, being forwardly spaced from said tray rear wall for facilitating access thereto.

9. The carton of claim 1 wherein said tray walls, upward from said periphery of said bottom panel, incline outward and are end joined.

10. The carton of claim 9 wherein said front edge of said partition panel is substantially coextensive with said upper edge of said front wall.

11. The carton of claim 10 wherein said front wall has an inner face, said front section of said partition panel being coextensive with said inner face.

12. The carton of claim 11 wherein said cover comprises a top panel with front and rear walls corresponding to said front and rear walls of said tray, and side walls corresponding to said side walls of said tray.

13. The carton of claim 12 wherein said partition panel, in said second position thereof, extends above said upper edges of said side walls, said partition being of a less height than the height of said carton between said tray bottom panel and said cover top panel in said closed position of said cover.

14. The carton of claim 9 wherein said cover comprises a top panel with front and rear walls corresponding to the front and rear walls of said tray, and side walls corresponding to said side walls of said tray, said cover side walls, in said closed position of said cover, overlying said tray side walls, said tray front wall, in said closed position of said cover, overlying said front wall, and cooperating releasable lock means on said cover and tray for releasably securing said cover in said closed position.

15. The carton of claim 14 wherein said lock means comprises keeper lugs integral and coplanar with said tray front wall and extending longitudinally thereof beyond the opposed side walls of said tray, and a lock lug integral and coplanar with each cover side wall and extending longitudinally therefrom forward of said cover front wall, said tray keeper lugs and said cover lock lugs extending mutually beyond each other at cross angles with said lock lugs, in said closed position of said cover, engaged below said keeper lugs.

16. The carton of claim 1 wherein said partition has a free outer edge remote from said intermediate section, said free outer edge, in said first position of said partition, being forwardly spaced from said tray rear wall for facilitating access thereto.

17. The carton of claim 16 wherein said bottom panel is of a predetermined width between said side walls, said intermediate section and said partition being of substantially equal width which is substantially equal to said predetermined width.

18. For use in the formation of a carton comprising a tray an cover, a planar blank of foldable sheet material, said blank having a longitudinal direction and including a bottom panel having opposed spaced transverse edges extending transversely of said blank and opposed longitudinal edges extending longitudinally of said blank, first and second wall panels extending respectively along said bottom panel first and second transverse edges, a top panel substantially dimensionally equal to said bottom panel and longitudinally extending from said second wall panel, said top panel having a third wall panel integral with said second wall panel and between said second wall panel and said top panel, said first wall panel of said bottom panel being of a progressively increasing transverse width outward of said bottom panel, said first wall panel having an outer edge of a transverse length greater than a transverse width of said bottom panel between the longitudinal edges thereof, and a partition panel integral with said outer edge of said first wall panel and extending longitudinally therebeyond, said partition panel including a first section immediately adjacent said first wall panel in the longitudinal direction of said blank, said first section having opposed end edges converging outwardly to a fold line of a transverse length substantially equal to the transverse width of said bottom panel, said partition panel including an intermediate section immediately outward of said first section and a partition section immediately outward of said intermediate section, said intermediate and partition sections being of a transverse width substantially equal to the transverse width of said bottom panel, and of a longitudinal length between said outer edge of said first section and a free outer edge on said partition panel which is less than the length of the bottom panel between said first and second wall panels thereof.

* * * * *